US012379172B2

(12) United States Patent
Dombeck

(10) Patent No.: US 12,379,172 B2
(45) Date of Patent: Aug. 5, 2025

(54) AMMUNITION FEED

(71) Applicant: RHEINMETALL AIR DEFENCE AG, Zurich (CH)

(72) Inventor: Christian Dombeck, Lauchringen (DE)

(73) Assignee: RHEINMETALL AIR DEFENCE AG, Zurich (CH)

( * ) Notice: Subject to any disclaimer, the term of this patent is extended or adjusted under 35 U.S.C. 154(b) by 0 days.

(21) Appl. No.: 17/907,241

(22) PCT Filed: Jul. 6, 2022

(86) PCT No.: PCT/EP2022/068785
§ 371 (c)(1),
(2) Date: Sep. 23, 2022

(87) PCT Pub. No.: WO2023/280940
PCT Pub. Date: Jan. 12, 2023

(65) Prior Publication Data

US 2024/0219133 A1 Jul. 4, 2024

(30) Foreign Application Priority Data

Jul. 8, 2021 (DE) ..... 102021117683.2

(51) Int. Cl.
*F41A 9/22* (2006.01)
*F41A 9/42* (2006.01)

(52) U.S. Cl.
CPC . *F41A 9/22* (2013.01); *F41A 9/42* (2013.01)

(58) Field of Classification Search
CPC ..... F41A 9/20; F41A 9/22; F41A 9/42
See application file for complete search history.

(56) References Cited

U.S. PATENT DOCUMENTS 16,797 A * 3/1857 Hicks ..... F41A 15/14 42/25
3,656,400 A * 4/1972 Stoner ..... F41A 15/08 89/193

(Continued)

*Primary Examiner* — Bret Hayes
(74) *Attorney, Agent, or Firm* — NGUYEN TARBET IP LAW

(57) ABSTRACT

The invention relates to an ammunition feed (1) for a gun barrel, in particular of an armoured vehicle, having at least one magazine and a rammer (2), the gun barrel having a loading space, it being possible for an ammunition (3) to be introduced from the magazine into the loading space by means of the rammer (2), and it being possible for an ammunition (3) to be led out of the loading space into the magazine by means of the rammer (2).

Figure 1:
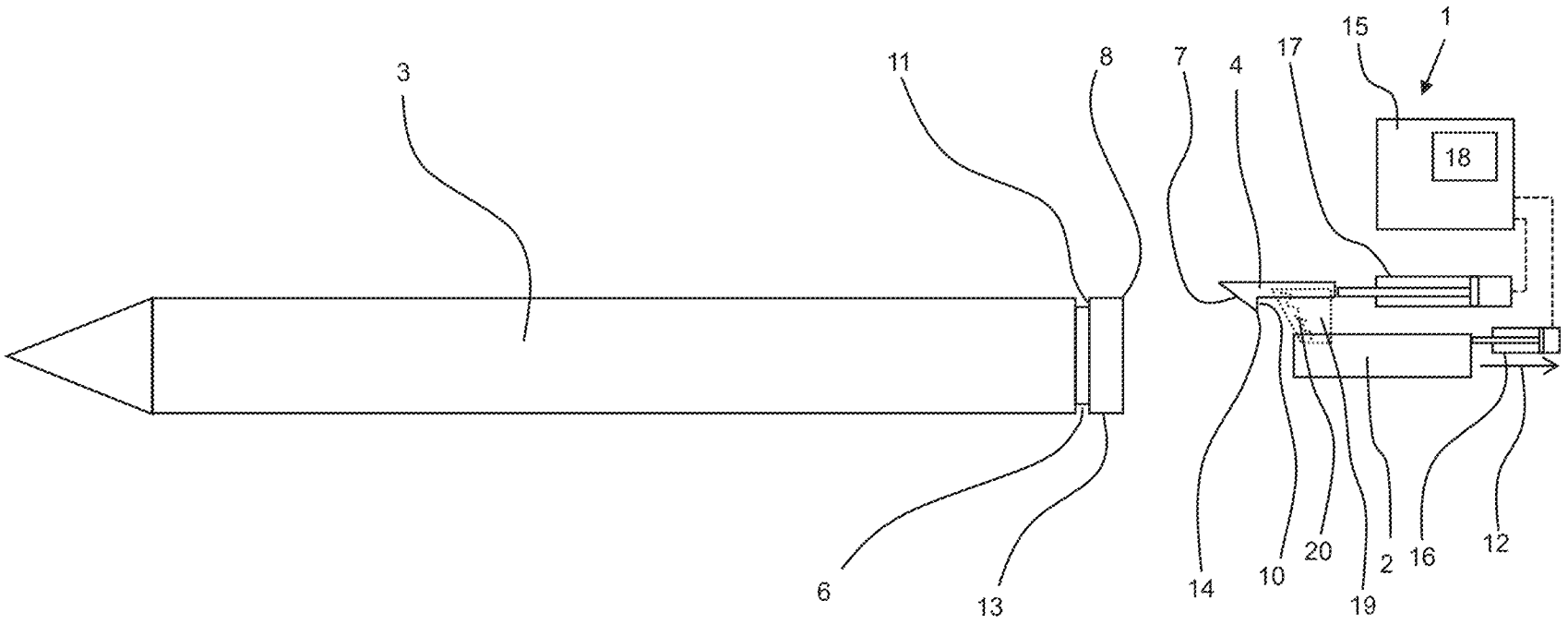

An ammunition (3) can be guided out of a loading space particularly quickly and reliably by means of the ammunition feed (1), in that a pawl (4) is arranged movably on an end of the rammer (2) facing the cartridge, the pawl (4) being positionable in an engagement position (5) in order to guide the ammunition (3) out of the loading space into the magazine, the pawl (4) being arranged in a recess (6) of the ammunition (3) in the engagement position (5), the ammunition feed (1) being designed as an automatic ammunition feed (1), a control device being provided, the control device being connected in terms of control technology to at least one actuator of the rammer (2) and at least one actuator of the pawl (4), a type of ammunition being automatically selected on the basis of data of automatic target detection and/or automatic target recognition, by means of which a high probability of hitting and destruction of a target to be combated can be achieved.

12 Claims, 3 Drawing Sheets

(56) References Cited

U.S. PATENT DOCUMENTS

| | | | | | |
|---|---|---|---|---|---|
| 3,680,242 | A * | 8/1972 | Wiese | F41A 15/14 | 42/25 |
| H211 | H * | 2/1987 | Vanderbeck | 42/25 | |
| 4,676,017 | A * | 6/1987 | Hurlemann | F41A 15/14 | 42/25 |
| 5,131,316 | A * | 7/1992 | Lawrence | F41A 9/26 | 89/46 |
| 5,758,445 | A * | 6/1998 | Casull | F42B 5/26 | 42/76.01 |
| 5,895,880 | A * | 4/1999 | Golden | F16G 13/20 | 89/47 |
| 6,272,967 | B1 * | 8/2001 | Bender-Zanoni | F41A 9/76 | 89/46 |
| 2021/0389070 | A1 * | 12/2021 | Bilbrey | G06V 40/103 | |

* cited by examiner

AMMUNITION FEED

The invention relates to an ammunition supply having the features of the generic concept of claim 1.

DE 35 17 056 A1 describes a device for transferring cartridged ammunition from a container magazine to a turret magazine. The tank and turret magazines are arranged in an armoured vehicle and associated with a weapon barrel of the armoured vehicle. A priming device or a primer, in particular a chain primer, can be used to insert cartridged ammunition from the turret magazine into a loading chamber of the gun barrel. By means of the attachment device, in particular the chain attachment device, the cartridged ammunition can also be withdrawn from the loading chamber of the barrel weapon into the turret magazine. The barrel weapon has a weapon barrel and the loading space, whereby the loading space is also referred to as the loading space in this document. The cartridge ammunition is also referred to in this document as ammunition or cartridge. To feed a cartridged ammunition from the hull magazine to the loading chamber of the barrel weapon or to draw a cartridged ammunition from the loading chamber of the barrel weapon into the hull magazine, the barrel weapon is swivelled. The hull magazine has its own attachment device. In order now to transfer a cartridge ammunition from the hull magazine into the turret magazine, the cartridge ammunition must first be introduced from the hull magazine into the empty cargo space of the gun, a barrel bore axis of the gun barrel and an axis of the cartridge ammunition arranged in the obliquely arranged hull magazine forming a straight line. Subsequently, the weapon barrel is pivoted toward the turret magazine, so that the attachment device of the turret magazine can pull the ammunition from the loading space of the gun. The turret magazine is arranged above the hull magazine.

In such a device for re-routing ammunition, it takes a relatively long time until a cartridge ammunition can be replaced by another cartridge ammunition. In particular, the pivoting of the weapon barrel requires a certain amount of time, also because of the usually high weight of the weapon barrel. This makes the device inflexible for re-munitioning. In modern armoured vehicles, however, the flexibility of the ammunition selection is very important, since only by using a suitable ammunition is it possible to achieve a high probability of hitting and destroying a target. If the re-munition takes too long and is therefore dispensed with, the probability of impact and destruction suffers. Especially due to the progressive automation of the weapon systems, with an ever better identification of the Targets and ammunition that is better adapted to the type of target, are increasingly demanding re-munition. A long duration of the process of re-munitioning thus has a negative effect on a cadence or fire rate.

In the case of the known ramming devices, the following problem also arises in the positioning of the ammunition in the loading space. By stopping the rammer, a pulse is transmitted from the rammer to the ammunition, whereby the ammunition slides a little further in the loading space. This slipping is a process which is difficult to control, if at all, and leads to an undefinable position of the ammunition in the loading space of the gun. An inaccurate positioning results in further problems, for example in the firing of the ammunition.

The invention is therefore based on the task of designing and further developing an ammunition feeder in such a way that an ammunition can be fed out of a loading chamber particularly quickly and safely by means of the ammunition feeder.

This object on which the invention is based is now first achieved by an ammunition feed according to the invention having the features of claim 1.

The basic principle of the invention lies first of all essentially in the fact that a pawl is arranged movably on an end of the rammer facing the cartridge, the pawl being positionable in an engagement position for guiding the ammunition out of the loading space into the magazine, the pawl being arranged in a recess of the ammunition in the engagement position, the ammunition feed being designed as an automatic ammunition feed, a control device being present, the control device being connected in terms of control technology to at least one actuator of the rammer and at least one actuator of the pawl, a type of ammunition, by means of which a high probability of hitting and destroying a target to be combated can be automatically selected on the basis of data of automatic target detection and/or automatic target recognition.

In this way, the ammunition can be pulled out of the loading space particularly quickly and reliably. This accelerates the process of re-munitioning as a whole and leads to a high degree of flexibility with regard to the short-term selection of the type of ammunition. An ammunition which is unsuitable for the just identified target but is arranged in the loading space can be quickly removed from the loading space, so that the latter is free for the supply of a more suitable ammunition. The removal can therefore also be carried out at short notice. Overall, despite the selection of different types of ammunition, a high cadence or firing rate of the gun can be achieved, in particular by the rapid and precise removal of the ammunition from the loading space.

During the removal of the ammunition from the loading space into the magazine, a force from the pawl acts on the ammunition, the force acting in the recess.

Furthermore, a pawl is distinguished as a simple and solid mechanism. The rapid withdrawal of the ammunition from the loading space is promoted by such a solid and thus robust mechanism. Such a simple mechanism can additionally be produced cost-effectively.

Advantageously, the pawl is also positioned in the engaged position prior to the introduction of the ammunition from the magazine into the loading space.

This enables the ammunition to be positioned accurately in the hold. The pawl in the engaged position prevents the ammunition from slipping further away from the rammer, even if a pulse is transmitted from the rammer to the ammunition when the rammer is stopped. Such an impulse is intercepted by the pawl.

In a further embodiment of the ammunition feed, the pawl is arranged pivotably on the rammer, it being possible for the distance of the pawl from a longitudinal axis of the ammunition to be varied by the pivoting movement.

A simple positioning of the pawl in the engaged position is made possible by the pivoting movement. In particular, the pawl is pivoted from above into the recess of the ammunition. Simple and thus cost-effective mechanisms can be used to implement such a pivoting movement.

Preferably, the pawl has a sliding edge, wherein the pawl can be guided into a release position of the pawl during an axial movement of the rammer towards the ammunition by means of the sliding edge on an end face of the ammunition facing the rammer.

In the release position of the pawl, an axial movement of the ammunition relative to the rammer in both directions, namely towards the rammer or away from the rammer, is made possible.

Due to the guidance of the pawl on the ammunition, the mechanism for moving the pawl can be carried out in a particularly simple manner. This guide controls an important part of the movement of the pawl, so that this control cannot be implemented by means of the mechanism.

Before an ammunition can be guided from the loading space into the magazine or from the magazine into the loading space, the rammer is guided to the ammunition with the pawl arranged at the cartridge-facing end of the rammer. In this case, the pawl comes into contact with the ammunition via the sliding edge of the pawl, in particular with the base of the ammunition. The rammer is guided further towards the cartridge, the pawl being moved further and further away from the longitudinal axis of the cartridge, in particular being pivoted away. The sliding edge is arranged obliquely with respect to the end-face base of the ammunition, as a result of which the pawl can be guided away from the longitudinal axis of the cartridge. When the distance between the rammer and the ammunition is further reduced, an end of the sliding edge is reached. As soon as the end of the sliding edge is reached, the pawl is no longer guided on the end-face base of the ammunition facing the rammer. The pawl is now in the release position. In the release position of the pawl, the pawl is either guided on an outer circumference of the ammunition or the pawl is located without contact, at a small distance above the ammunition.

The pawl is preferably movable, in particular pivotable, out of the release position into the engagement position. In order to move the pawl, one or more actuators are operatively arranged between the rammer and the pawl.

Advantageously, the pawl has a holding edge, the holding edge in the engaged position of the pawl cooperating with a wall or an edge of the recess in such a way that a movement of the ammunition away from the rammer is avoided and/or that the ammunition can be moved by means of the rammer in an unloading direction, in particular out of the loading space.

By means of the holding edge, a sufficiently high force can be transmitted between the pawl and the ammunition in the desired direction, namely the unloading direction.

In the engaged position of the pawl, the retaining edge is preferably aligned essentially perpendicular to the longitudinal axis of the ammunition.

Essentially perpendicular means that a certain oblique position of the retaining edge relative to the longitudinal axis of the ammunition is possible, wherein an angle between a perpendicular to the longitudinal axis of the ammunition and the retaining edge is not more than 20°. This ensures that the pawl does not slip out of the recess of the ammunition in an undesired manner. The pawl remains in the engaged position even in the event of impact loads on the gun or the armoured vehicle on which the gun is arranged.

In a further embodiment of the ammunition feed, a sleeve bottom collar of the ammunition is arranged between the holding edge and the rammer in the engaged position of the pawl.

In particular, the ammunition is clamped between the pawl and the rammer by means of its sleeve bottom collar. A particularly precise and thus fast guidance of the ammunition with the rammer and the pawl arranged on the rammer is thus possible. Under certain circumstances, a distance between the rammer and the retaining edge of the pawl in the engaged position is somewhat greater than a width of the sleeve bottom collar, so that a slight play results. However, this play is then so small that it does not have a negative effect on the precision and speed of the guidance of the ammunition with the rammer.

After the ammunition has been introduced from the magazine into the loading space, the pawl is preferably movable out of the engaged position, so that the rammer can be retracted from the weapon barrel without the ammunition.

For this purpose, the pawl is at least briefly guided into its release position by means of corresponding actuators. Only in this release position is it possible to withdraw the rammer from the weapon barrel or the loading space of the weapon barrel without the ammunition. The release position is further characterized in that the retaining edge of the pawl does not cooperate with the wall or the edge of the recess or is not in contact with the wall or the edge of the recess. After the retraction of the rammer, the rammer can be used directly, that is to say without a time delay, for a renewed supply of a new ammunition from the magazine to the loading space.

In a preferred embodiment of the ammunition feed, a gear mechanism (19) is arranged between the pawl and the rammer.

By means of the gear, a simple conversion of the movement of the pawl, for example a pivoting movement of the pawl, in a desired movement path is possible. The gear can be embodied in various ways, the decisive factor being precise and rapid guidance of the pawl, in particular between the release position and the engagement position and vice versa.

The gear advantageously has a restoring spring (20), a force acting on the pawl by means of the restoring spring (20), the pawl being movable into the engaged position by means of this force.

Such a restoring spring (20) is a special embodiment of an actuator of the gear, which in this case is passive. Before the pawl is guided into the engaged position, the pawl is pressed onto an outer circumference of the ammunition with the force applied by the restoring spring (20). If the pawl reaches the recess due to a further approach of the rammer to the ammunition, the pawl is pulled or pressed into the recess due to the force of the restoring spring (20).

Due to the return spring, the pawl automatically slides into the engaged position at a given time.

Such a restoring spring (20) is particularly reliable in its function and can be obtained in a favourable manner. The restoring spring (20) is designed, for example, as a tension spring or as a compression spring. Particular preference is given to the use of helical springs.

The ammunition feed is designed as an automatic ammunition feed.

For this purpose, a control device (15) is provided, the control device (15) being connected in terms of control technology to at least one actuator of the rammer (16), at least one actuator of the pawl (17) and possibly further actuators of further elements of the gun. Such a control device (15) also contains, for example, data for automatic target detection and/or automatic target recognition (18). On the basis of such data, an ammunition type can be automatically selected within the control device (15), by means of which ammunition type a high probability of hitting and destroying the target to be combated can be achieved. The control device (15) checks whether this selected ammunition is located in the hold. If this is not the case, the appropriate ammunition is automatically introduced into the loading space with the aid of actuating commands generated in the control device (15). If the cargo space is occupied by another ammunition, then the sensors connected by means of the control device (15) and correspondingly to the control device (15) can also be detected and the undesired ammunition is first returned from the cargo space into the Magazine. By means of the automatic ammunition feed, duds can also advantageously be removed automatically from the weapon barrel.

In one embodiment, a plurality of pawls are present. The pawls can in particular be arranged symmetrically on the rammer. By means of a plurality of pawls, a better force distribution can be achieved during the unloading process, since in particular tensile forces act on the ammunition in its sum axially parallel to the ammunition axis.

Figure 2:
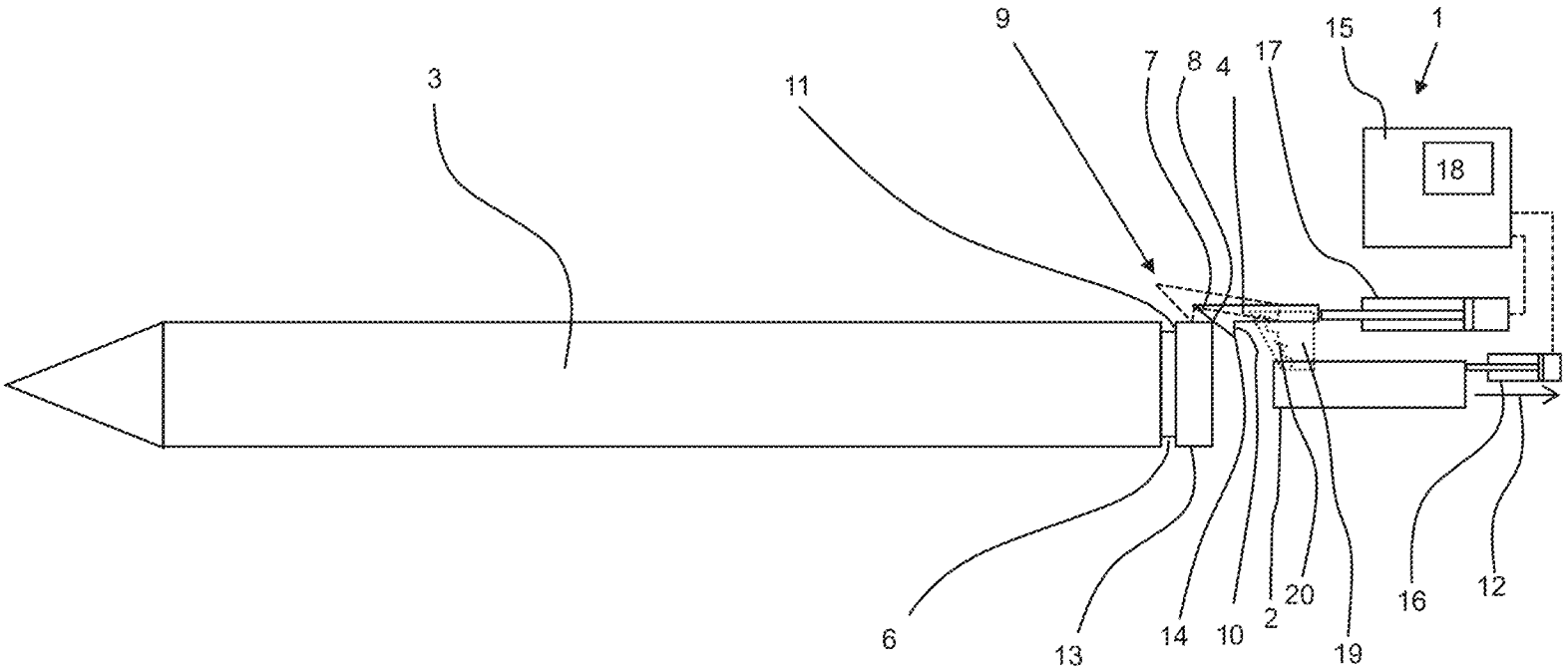
Figure 3:
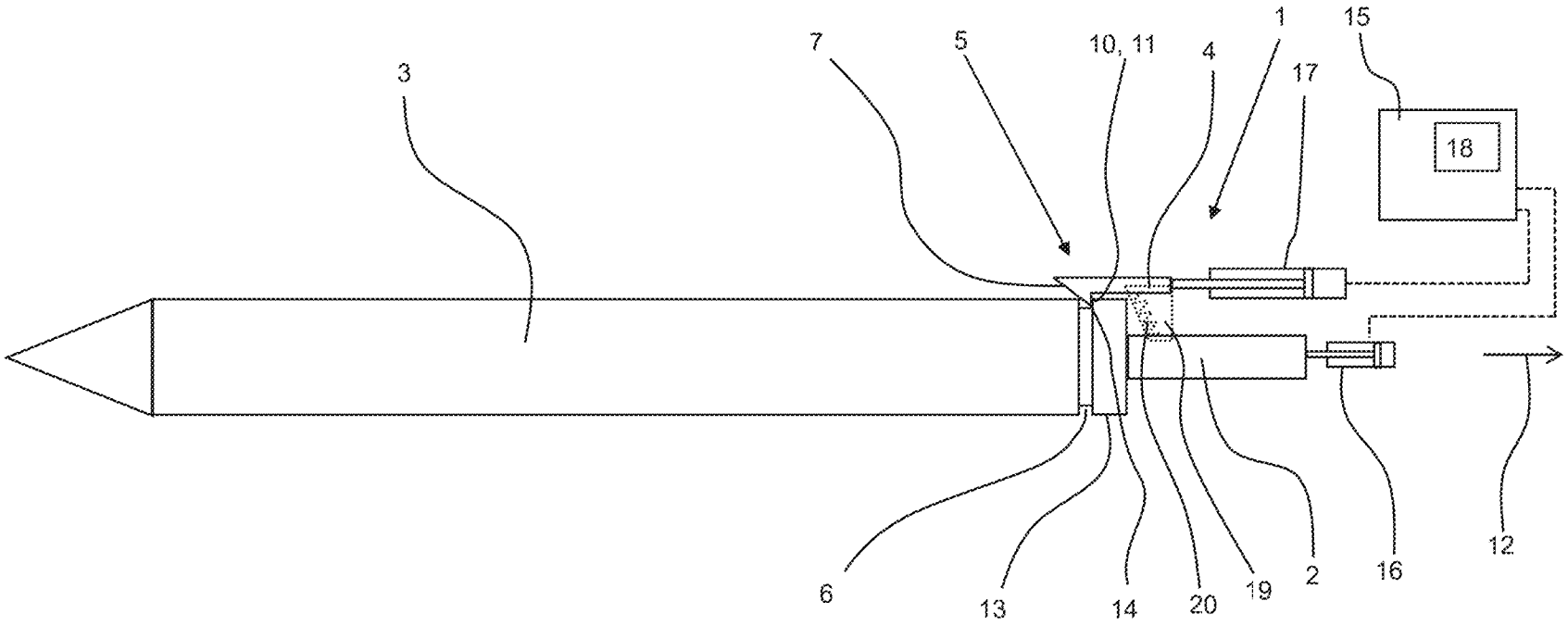

There are a large number of possibilities for embodying and further developing the ammunition feed according to the invention. Reference may first be made to the claims subordinate to claim 1. In the following, a preferred embodiment of the ammunition feed system according to the invention will now be explained in more detail with reference to the drawing and the associated description. In the drawing:

FIG. 1 schematically shows an embodiment of an ammunition feed before an axial movement of a rammer towards an ammunition in a side view in section, FIG. 2 schematically shows the embodiment of the ammunition feed during an axial movement of the rammer towards the ammunition in a side view in section, and FIG. 3 schematically shows an embodiment of the ammunition feed with a pawl in an engaged position in a side view in section.

FIG. 1 schematically shows a side view of an embodiment of an ammunition feed 1 before an axial movement of a rammer 2 towards an ammunition 3. The ammunition feed 1 is arranged adjacent to a weapon barrel (not shown here). The weapon barrel is part of a barrel weapon which is arranged, for example, on an armoured vehicle. In addition to the rammer 2, the ammunition feeder 1 has at least one magazine, which is likewise not shown. A loading space is arranged or formed in the weapon barrel. The ammunition 3 can be introduced from the magazine into the loading space by means of the rammer 2. The ammunition 3 can also be guided out of the loading space into the magazine by means of the rammer 2. A suitable drive is provided for moving the rammer 2. The drive could be designed, for example, as an electric motor. Hydraulic or pneumatic drives of the rammer 2 are also conceivable.

A pawl 4 is movably arranged at an end of the rammer 2 facing the cartridge. In order to guide the ammunition 3 out of the loading space into the magazine, the pawl 4 is positioned in an engaged position 5. In the engaged position 5, the pawl 4 is arranged in a recess 6 of the ammunition 3. The recess 6 of the ammunition 3 is usually designed as a circumferential groove.

The pawl 4 is likewise positioned in the engagement position 5 before the ammunition 3 is introduced from the magazine into the loading space. Thus, when the ammunition 3 is inserted into the loading chamber, the ammunition 3 is axially secured relative to the attachment 2, i.e., the ammunition 3 cannot move relative to the attachment 2 during the process of inserting the ammunition 3 into the loading chamber.

The pawl 4 is pivotally mounted on the rammer 2. As a result of the pivoting movement, a distance between the pawl 4 and a longitudinal axis of the ammunition 3 can be varied. Alternatively, a rectilinear movement between the pawl 4 and the rammer 2 is also conceivable if, as a result, the distance of the pawl 4 from the longitudinal axis of the ammunition 3 can also be varied.

The pawl 4 has a sliding edge 7. The sliding edge extends obliquely to the longitudinal axis, in particular at an acute angle to the longitudinal axis. During an axial movement of the rammer 2 towards the ammunition 3, the pawl 4 can be guided into a release position 9 of the pawl 4 by means of the sliding edge 7 on a frontal base 8 of the ammunition 3 facing the rammer 2. In FIG. 2, this situation is shown in section in a side view during the axial movement of the rammer 2 towards the ammunition 3. The same reference numerals are used for FIG. 2 as for FIG. 1. The release position 9 is shown in FIG. 2 by dashed lines. In the release position 9 of the pawl 4, an axial movement of the ammunition 3 relative to the rammer 2 is possible in both directions, namely towards the attacher 2 or away from the rammer 2. The release position 9 of the pawl 4 is further characterized in particular by the fact that in the release position 9 the pawl 4 is not at least partially located in the recess 6. In the release position 9, the pawl 4 has in particular a distance to the longitudinal axis of the ammunition 3 which is greater than or at least equal to a distance of an outer boundary of the recess 6 to the longitudinal axis of the ammunition 3. As shown in FIG. 2, the pawl 4 could rest in its release position 9, for example, on an outer circumference of the ammunition 3.

The pawl 4 can be moved out of the release position 9 into the engagement position 5. In particular, this occurs at the time when the rammer 2 reaches the ammunition 3, or shortly before the piecer 2 reaches the ammunition 3.

The pawl 4 has a holding edge 10. In the engagement position 5 of the pawl 4, the retaining edge 10 interacts with a wall 11 or an edge of the recess 6 in such a way that movement of the ammunition 3 away from the attacher 2 is prevented. Furthermore, the ammunition 3 can be moved by means of the rammer 2 in an unloading direction 12, in particular out of the loading space. This situation is shown in FIG. 3. In FIG. 3, the same reference numerals are used as for the preceding figures. The unloading direction 12 points to the right in each case in FIGS. 1 to 3 and is symbolized by means of an arrow.

The retaining edge 10 is oriented substantially perpendicular to a longitudinal axis of the ammunition 3 in the latch engagement position 5. An angle of the holding edge 10 to a perpendicular to the longitudinal axis of the ammunition 3 is a maximum of 20°. The holding edge 10 could therefore also be arranged slightly obliquely in the engaged position 5. It is only important that the pawl 4 does not slip out of the engaged position 5 in a faulty manner.

The ammunition 3 usually has a sleeve base collar 13 facing the rammer 2, the recess 6 being formed by means of the sleeve base collar 13, in particular as a circumferential groove.

In the engaged position 5 of the pawl 4, the sleeve bottom collar 13 of the ammunition 3 is arranged between the holding edge 10 and the rammer 2. Thus, a secure connection between the ammunition 3 and the rammer 2 is achieved. The sleeve bottom collar 13 is either clamped between the pawl 4 and the rammer 2 or is arranged with slight play between the pawl 4 and the rammer 2. In both cases, the ammunition 3 and the rammer 2 form a unit which can be moved together, in particular by means of a drive associated with the rammer 2.

After the ammunition 3 has been introduced into the loading space, the pawl 4 can be moved out of the engaged position 5 by the magazine. Subsequently, the rammer 2 can be retracted from the weapon barrel without the ammunition 3. Subsequently, for example, the ammunition 3 could be fired by means of the weapon barrel. Alternatively, it is conceivable that the ammunition 3 is to be exchanged for a more suitable ammunition 3 with respect to the target to be fought. In this case, the ammunition 3 is first pulled out of the loading space again by means of the rammer 2 and the pawl 4.

A gear mechanism (19) is arranged between the pawl 4 and the rammer 2. The gear has, for example, struts and joints. By means of such elements, various movement paths of the pawl 4 can be done. In particular, the struts and joints are designed in such a way that a pivoting movement of the pawl 4 is made possible.

The gear additionally has a restoring spring. A force acts on the pawl 4 by means of the restoring spring, the pawl 4 being movable into the engaged position 5 by means of this force. For this purpose, the force exerted on the pawl 4 by means of the restoring spring acts in the direction of the longitudinal axis of the ammunition 3.

The process in which the rammer 2 is guided to the ammunition 3 is described below. This may be necessary both when the ammunition 3 is located in the magazine and when the ammunition 3 is located in the loading space of the weapon barrel. During this process, the rammer 2 is guided from the position shown in FIG. 1, in which the rammer 2 is arranged at an axial distance from the ammunition 3, via the position shown in FIG. 2, to the position shown in FIG. 3, the rammer 2 contacting an end face of the ammunition 3 in the position shown in FIG. 3. The pawl 4 is initially in a rest position in the position of the rammer 2 shown in FIG. 1. A movement of the pawl 4 due to the restoring spring does not take place in this position. Either the restoring spring is not tensioned or the restoring spring is tensioned, in particular prestressed, but a movement of the pawl 4 is prevented by a corresponding stop. The rammer 2 is now guided to the ammunition 3 until the pawl 4 comes into contact with the ammunition 3. The contact arises between the sliding edge 7 of the pawl 4 and the end-face base 8 of the ammunition 3. The end face bottom 8 is part of the sleeve bottom collar 13. When the rammer 2 approaches the ammunition 3 further, the pawl 4 slides along the frontal base 8 and is thereby pushed away from the longitudinal axis of the ammunition 3 against the force exerted on the pawl 4 by the return spring. Once the end of the sliding edge 7 is reached and the piecer 2 continues to approach the ammunition 3, the pawl 4 is guided with a tip 14 on an outer circumference of the ammunition 3, in particular on an outer circumference of the case bottom collar 13, until the tip 14 reaches the recess. The tip 14 of the pawl 4 is formed at the meeting point of the holding edge 10 and the sliding edge 7. If the rammer 2 is fed a further piece onto the ammunition 3, the contact between the tip 14 of the pawl 4 and the outer circumference of the sleeve bottom collar 13 is first released. The force exerted by the restoring spring on the pawl 4 now results in the pawl 4 being pulled with its tip 14 into the recess 6, so that the pawl 4 is in the engaged position 5. The ammunition 3 can now be pulled out of the loading space in the unloading direction 12, for example, by means of the rammer 2 and the pawl 4.

The ammunition feed is designed as an automatic ammunition feed. The processes described above are carried out automatically by means of a control device (15) and actuators (16, 17) connected to the control device (15) in terms of control technology. Due to the progressive automation of the higher-level units, such as the weapon barrel and/or the entire armoured vehicle, the automation of the ammunition supply is also useful for achieving a coherent overall concept. Part of the progressive automation are, for example, improved target recognition and improved selection of a suitable ammunition for the target. Furthermore, more and more different types of ammunition are available. This requires the use of different types of ammunition in different situations, namely in the fight against different targets. It is often necessary to react quickly and flexibly, which is made possible by the rapid exchange of the ammunition by means of the ammunition feed described here.

LIST OF REFERENCE NUMERALS

1. Ammunition feed
2. Rammer
3. Ammunition
4. Pawl
5. Disengagement position
6. Recess
7. Sliding edge
8. End face floor
9. Release position
10. Retaining edge
11. Wall
12. Unloading direction
13. Sleeve bottom collar
14. Lace
15. Control Device
16. Actuator of Rammer
17. Actuator of Pawl
18. Automatic Target Detection/Recognition Means
19. Gear Mechanism
20. Restoring Spring

The invention claimed is:

1. Ammunition feed (1) for a gun barrel having at least one magazine and a rammer (2), wherein the gun barrel is for an armoured vehicle, the gun barrel having a loading space, wherein a piece of ammunition (3) is introducible from the magazine into the loading space by the rammer (2), and wherein the piece of ammunition (3) is reversible out of the loading space into the magazine by the rammer (2), characterized in that:

a pawl (4) is arranged movably on an end of the rammer (2) facing the piece of ammunition, the pawl (4) having a tip (14) formed at a meeting point of a holding edge (10) and a sliding edge (7) of the pawl, wherein the tip (14) of the pawl faces towards the rammer (2), the pawl (4) can be positioned in an engagement position (5) to reverse out the piece of ammunition (3) from the loading space into the magazine, wherein the pawl (4) in the engagement position (5) prevents the piece of ammunition (3) from slipping further away from the rammer (2), wherein the pawl (4) is arranged in a recess (6) of the piece of ammunition (3) in the engagement position (5), wherein a retaining edge is preferably aligned essentially perpendicular to the longitudinal axis of the ammunition wherein the ammunition feed (1) is designed as an automatic ammunition feed (1), wherein a control device (15) is provided, wherein the control device (15) is connected to at least one actuator (16) of the rammer (2) and at least one actuator (17) of the pawl (4), wherein the control device (15) is designed to automatically select a suitable piece of ammunition (3) on basis of data from an automatic target detection device (18);

wherein the suitable piece of ammunition (3) is automatically introducible into the loading space with the aid of actuating commands generated in the control device (15).

2. The ammunition feed (1) according to claim 1, characterised in that the pawl (4) is positioned in the engagement position (5) prior to the introduction of the piece of ammunition (3) from the magazine into the loading space.

3. The ammunition feed (1) according to claim 1, characterized in that the pawl (4) is arranged pivotably on the rammer (2), wherein a distance of the pawl (4) from a longitudinal axis of the piece of ammunition (3) is varied by a pivoting movement of the pawl (4).

4. The ammunition feed (1) according to claim 1, characterized in that the pawl (4) has a sliding edge (7), wherein during an axial movement of the rammer (2) towards the piece of ammunition (3), the pawl (4) is to be guided by the sliding edge (7) on an end-face base (8) of the piece of ammunition (3) facing the rammer (2) into a release position (9) of the pawl (4).

5. The ammunition feed (1) according to claim 4, characterized in that the pawl (4) can be moved out of the release position (9) into the engagement position (5).

6. The ammunition feed (1) according to claim 1, characterized in that the holding edge (10), in the engagement position (5) of the pawl (4), interacting with a wall (11) or an edge of the recess (6) in such a way that a movement of the piece of ammunition (3) away from the rammer (2) is avoided and/or in that the piece of ammunition (3) can be moved by the rammer (2) in an unloading direction (12).

7. The ammunition feed (1) according to claim 6, characterised in that the holding edge (10) is aligned substantially perpendicular to a longitudinal axis of the ammunition (3) in the engagement position (5) of the pawl (4).

8. The ammunition feed (1) according to claim 7, characterised in that in the engagement position (5) of the pawl (4) a sleeve base collar (13) of the ammunition (3) is arranged between the holding edge (10) and the rammer (2).

9. The ammunition feed (1) according to claim 6, characterised in that in the engagement position (5) of the pawl (4) a sleeve base collar (13) of the piece of ammunition (3) is arranged between the holding edge (10) and the rammer (2).

10. The ammunition feed (1) according to claim 1, characterized in that, after the piece of ammunition (3) has been introduced from the magazine into the loading space, the pawl (4) can be moved out of the engagement position (5), such that the rammer (2) can be retracted from the gun barrel without the piece of ammunition (3).

11. The ammunition feed (1) according to claim 1, characterized in that a gear mechanism (19) is arranged between the pawl (4) and the rammer (2).

12. The ammunition feed (1) according to claim 11, characterised in that the gear mechanism (19) has a restoring spring (20), wherein a force acts on the pawl (4) by the restoring spring (20), wherein the pawl (4) can be moved into the engagement position (5) by means of the force.

* * * * *